US011453562B2

(12) United States Patent
Touchstone et al.

(10) Patent No.: US 11,453,562 B2
(45) Date of Patent: Sep. 27, 2022

(54) FILL INDICATOR ROLLERS FOR PRINTER TRAYS

(71) Applicant: Hewlett-Packard Development Company, L.P., Spring, TX (US)

(72) Inventors: Hallie Touchstone, Boise, ID (US); Bradley Spencer White, Boise, ID (US); Robert C. Lopez, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/257,955

(22) PCT Filed: Nov. 9, 2018

(86) PCT No.: PCT/US2018/060193

§ 371 (c)(1),
(2) Date: Jan. 5, 2021

(87) PCT Pub. No.: WO2020/096624

PCT Pub. Date: May 14, 2020

(65) Prior Publication Data

US 2021/0269264 A1 Sep. 2, 2021

(51) Int. Cl.
*B65H 1/04* (2006.01)

(52) U.S. Cl.
CPC ..... *B65H 1/04* (2013.01); *B65H 2402/5152* (2013.01); *B65H 2405/1142* (2013.01); *B65H 2511/12* (2013.01)

(58) Field of Classification Search
CPC ..... B65H 1/04; B65H 2405/114; B65H 2405/1142; B65H 2405/11425; B65H 2405/1144; B65H 2405/115; B65H 2405/12; B65H 2405/141; B65H 2511/12; B65H 2402/5152
See application file for complete search history.

(56) References Cited

U.S. PATENT DOCUMENTS

| | | | |
|---|---|---|---|
| 4,772,007 | A | 9/1988 | Kashimura |
| 5,078,379 | A | 1/1992 | Leisner |
| 5,387,980 | A | 2/1995 | Baitz et al. |
| 5,596,399 | A | 1/1997 | Dempsey et al. |
| 6,050,565 | A | 4/2000 | Fetherolf |
| 6,057,936 | A | 5/2000 | Obara et al. |
| 6,206,362 | B1 | 3/2001 | Tan et al. |
| 6,986,509 | B2 | 1/2006 | Koh et al. |

(Continued)

FOREIGN PATENT DOCUMENTS

| | | | |
|---|---|---|---|
| JP | 03-284476 | A | 12/1991 |
| JP | H0459521 | A | 2/1992 |

(Continued)

*Primary Examiner* — Prasad V Gokhale
(74) *Attorney, Agent, or Firm* — Mannava & Kang

(57) ABSTRACT

Example feed trays for a printer are disclosed. In one example, the feed tray includes a support surface to support print media, and a guide wall coupled to the support surface. The support surface and the guide wall define a feed path for the print media into the printer, and the guide wall is movable along the support surface. In addition, the feed tray includes a fill indicator comprising a roller mounted to the guide wall that extends into the feed path. The roller is to rotate about an axis of rotation that is perpendicular to the feed path.

14 Claims, 10 Drawing Sheets

(56) References Cited

U.S. PATENT DOCUMENTS

| | | | | |
|---|---|---|---|---|
| 7,159,863 | B2 | 1/2007 | Murrell et al. | |
| 7,374,163 | B2 | 5/2008 | Cook et al. | |
| 7,677,557 | B2 | 3/2010 | Ino | |
| 7,857,303 | B2 | 12/2010 | Oomori et al. | |
| 8,246,041 | B2 | 8/2012 | Gagnon et al. | |
| 8,393,613 | B2 | 3/2013 | Chen | |
| 2007/0057428 | A1 | 3/2007 | Luo | |
| 2009/0206544 | A1 | 8/2009 | Allwright | |
| 2011/0037220 | A1* | 2/2011 | Nishinakama | B65H 1/02 271/253 |
| 2013/0174753 | A1* | 7/2013 | Jeter | B41F 31/15 101/350.3 |
| 2016/0096699 | A1* | 4/2016 | Wada | B65H 9/08 271/240 |
| 2017/0001819 | A1* | 1/2017 | Shiba | B65H 1/266 |

FOREIGN PATENT DOCUMENTS

| | | | |
|---|---|---|---|
| JP | 09-240887 | A | 9/1997 |
| JP | 3284476 | B2 | 5/2002 |
| WO | WO-2018048451 | A1 | 3/2018 |

* cited by examiner

FILL INDICATOR ROLLERS FOR PRINTER TRAYS

BACKGROUND

Printers may employ feed trays for the storage of print media (e.g., paper) that is used for printing operations. Such trays may be disposed internally to the printer or externally (e.g., such as a printing tray that folds out from the side of a printer housing). Regardless of the precise location of the feed tray, during a printing operation, print media is drawn from the feed tray into the printer, and an image is deposited thereon.

BRIEF DESCRIPTION OF THE DRAWINGS

Various examples will be described below referring to the following figures.

DETAILED DESCRIPTION

In the figures, certain features and components disclosed herein may be shown exaggerated in scale or in somewhat schematic form, and some details of certain elements may not be shown in the interest of clarity and conciseness. In some of the figures, in order to improve clarity and conciseness, a component or an aspect of a component may be omitted.

In the following discussion and in the claims, the terms "including" and "comprising" are used in an open-ended fashion, and thus should be interpreted to mean "including, but not limited to . . . ." Also, the term "couple" or "couples" is intended to be broad enough to encompass both indirect and direct connections. Thus, if a first device couples to a second device, that connection may be through a direct connection or through an indirect connection via other devices, components, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis.

As used herein, including in the claims, the word "or" is used in an inclusive manner. For example, "A or B" means any of the following: "A" alone, "B" alone, or both "A" and "B." In addition, when used herein (including the claims) the words "generally," "about," "approximately," or "substantially" mean within a range of plus or minus 20% of the stated value.

As previously described above, printers may employ feed trays for the storage of print media. Various parameters, such as the physical size and shape of the feed tray, the size and shape of the opening into the printer, and the position and range of motion of rollers or other components for drawing the print media into the printer during a printing operation, among others, impose a stack height limit for print media stored or inserted within the feed tray. If the print media is loaded within the feed tray above the stack height limit, subsequent printing operations may be frustrated due to, for example, jamming or skewing of the print media due to the oversized stack within the feed tray. Accordingly, examples disclosed herein include fill indicators for a printer feed tray that provide a physical barrier to prevent (or at least discourage) the insertion of print media into the feed tray above the stack height limit.

Figure 1:
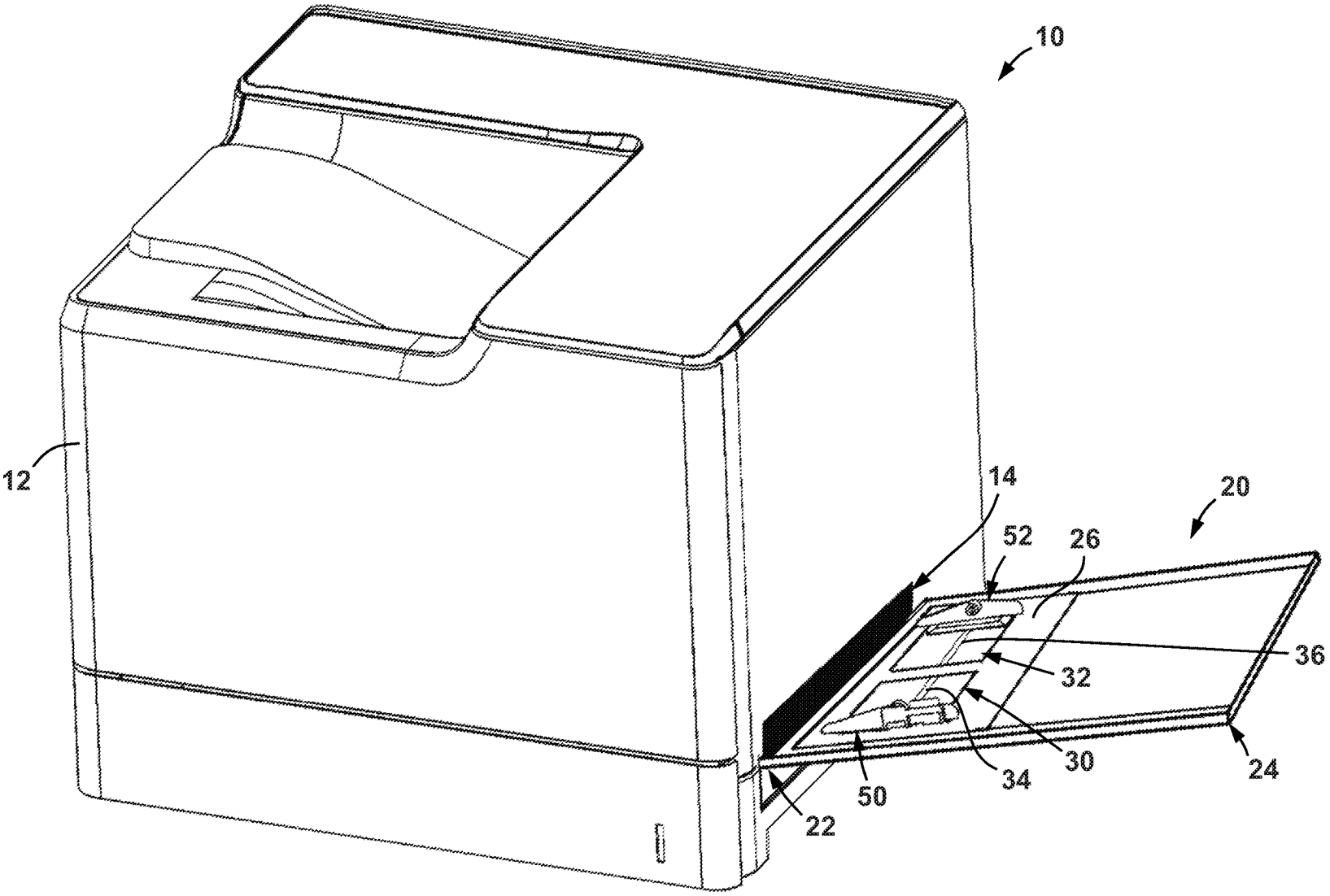
FIG. 1 is a perspective view of a printer according to some examples.

Referring now to FIG. 1, a printer 10 according to some examples is shown. Printer 10 may be any suitable printing device, such as, for example, an inkjet printer, a laser printer, a dot-matrix printer, etc. In this example, printer 10 generally includes a housing 12 and an external feed tray 20.

Figure 2:
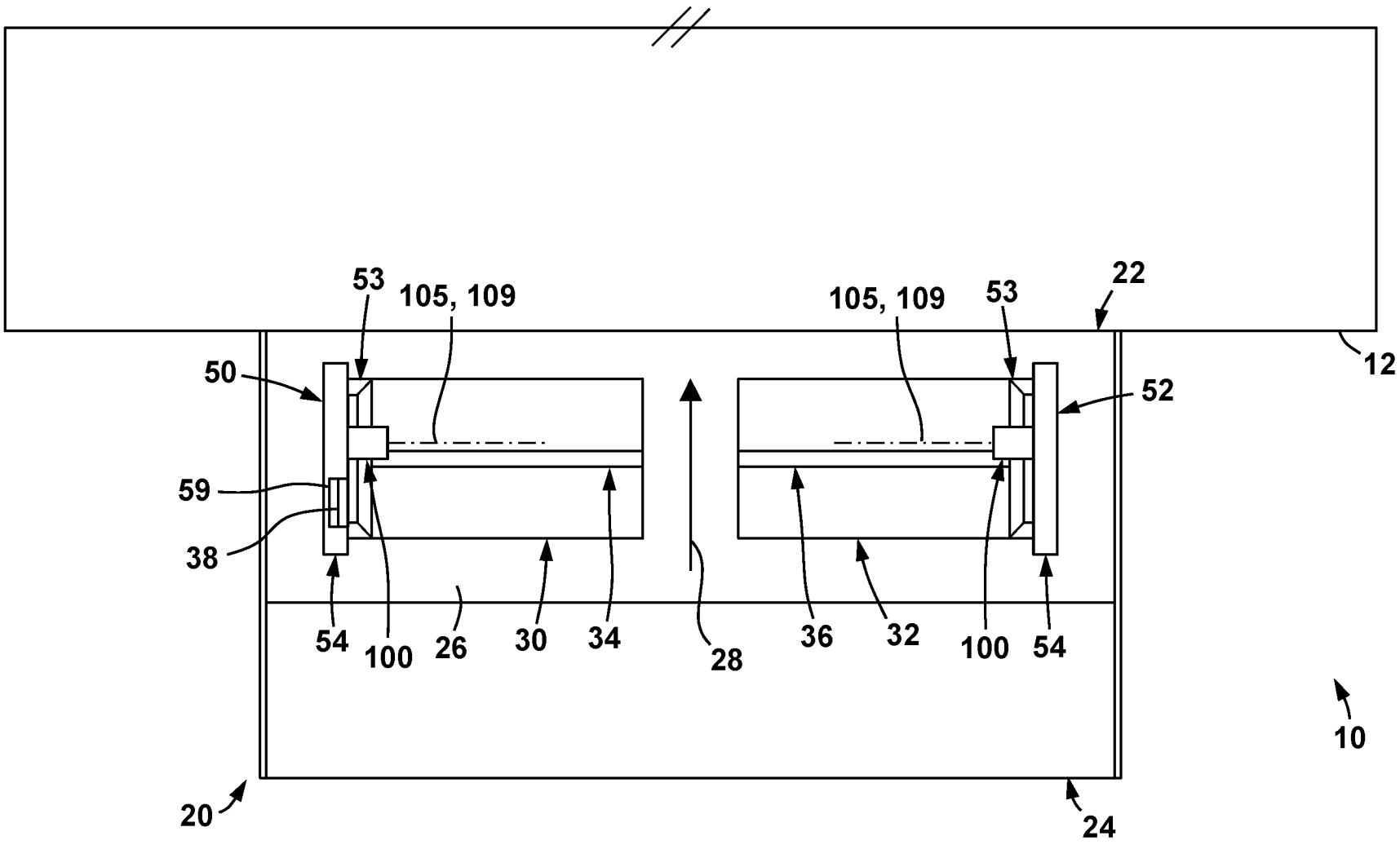
FIG. 2 is a schematic top view of a feed tray of the printer of FIG. 1 according to some examples.

Referring now to FIGS. 1 and 2, feed tray 20 includes a first or proximal end 22, and a second or distal end 24 opposite proximal end 22. In this example, feed tray 20 is a fold-out side feed tray for printer 10, and thus, proximal end 22 is rotatably coupled to housing 12, such that feed tray 20 may be transitioned between a folded position (where distal end 24 is disposed proximate or against housing 12) and a deployed position (where distal end 24 is extended away from housing 12). FIGS. 1 and 2 depict feed tray 20 in the deployed position.

In addition, feed tray 20 includes a support surface 26 disposed between ends 22, 24. As will be described in more detail below, support surface 26 is to support a stack of print media thereon such that the print media may be drawn (e.g., by rollers or other components that are not directly shown in FIG. 1) into an opening 14 in printer housing 12 adjacent feed tray 20 during a printing operation. Further, feed tray 20 includes a pair of side guides coupled to support surface 26—particularly a first side guide 50, and a second side guide 52. Side guides 50, 52 are to laterally guide the print media on support surface 26 to facilitate proper feeding thereof during a printing operation. Side guides 50, 52 are disposed within corresponding recesses 30, 32, respectively, in support surface 26, and are movable relative to support surface 26 via a pair of corresponding slots 34, 36, respectively.

As best shown in FIG. 2, support surface 26 and side guides 50, 52 (particularly the guide walls 54 of side guides 50, 52, as described in more detail below) define a feed path 28 across support surface 26 and into opening 14 (see FIG. 1) of printer housing 12. During a printing operation, print media (not shown in FIG. 1) is disposed upon support surface 26 between side guides 50, 52 and is drawn into opening 14 along feed path 26 by a suitable device or mechanism (e.g., feed roller(s)—not shown).

In this example, feed tray 20 may receive multiple sizes (e.g., widths) of print media. As a result, the side guides 50, 52 are to move relative to support surface 26 along slots 34, 36, respectively, in a direction that is generally perpendicular to the feed path 28 (as a result, slots 34, 36 are generally oriented perpendicularly to feed path 28). In this example, first side guide 50 has a latch or button 38 that may be manipulated (e.g., depressed, pulled, etc.) to allow side guides 50, 52 to traverse along slots 34, 36, respectively. Because the mechanism allowing the adjustment or movement of side guides 50, 52 is not pertinent to the current disclosure, further details are not provided herein. In addition, it should be appreciated that in other examples, one of the side guides 50, 52 is to move along support surface 26, rather than both as in this example. Further, in still other examples, neither of the sides guides 50, 52 are to move along support surface 26.

Figure 3:
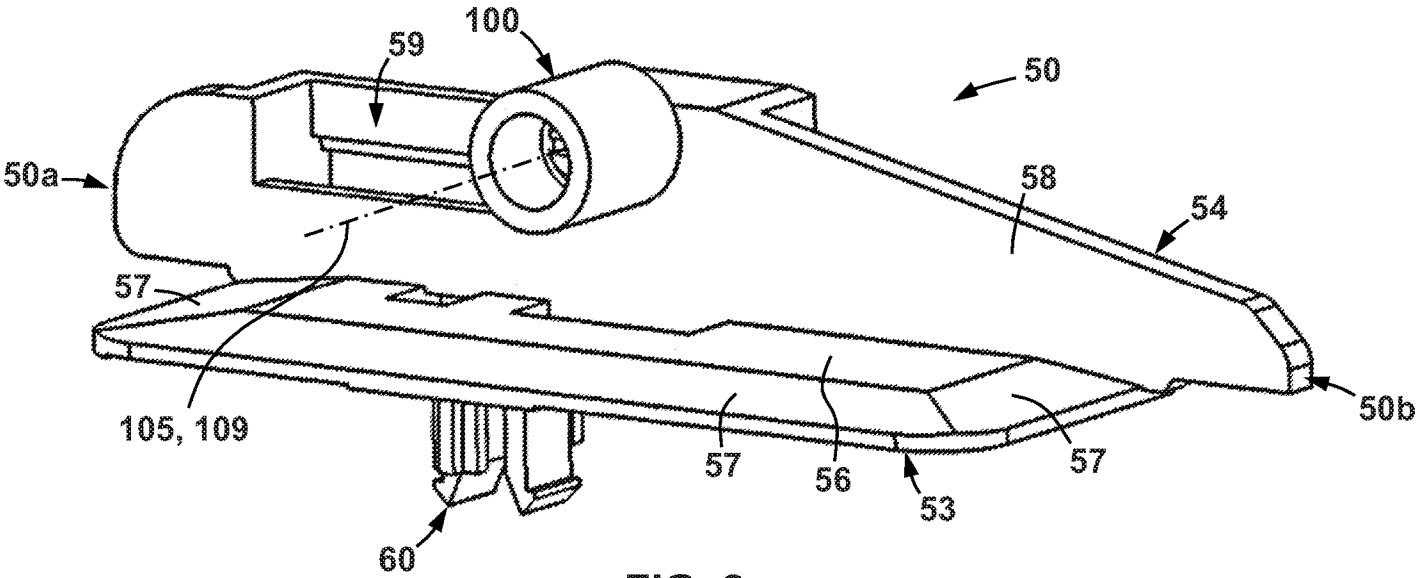
FIGS. 3 and 4 are perspective views of a first side guide for use within the feed tray of FIG. 2 according to some examples.
Figure 4:
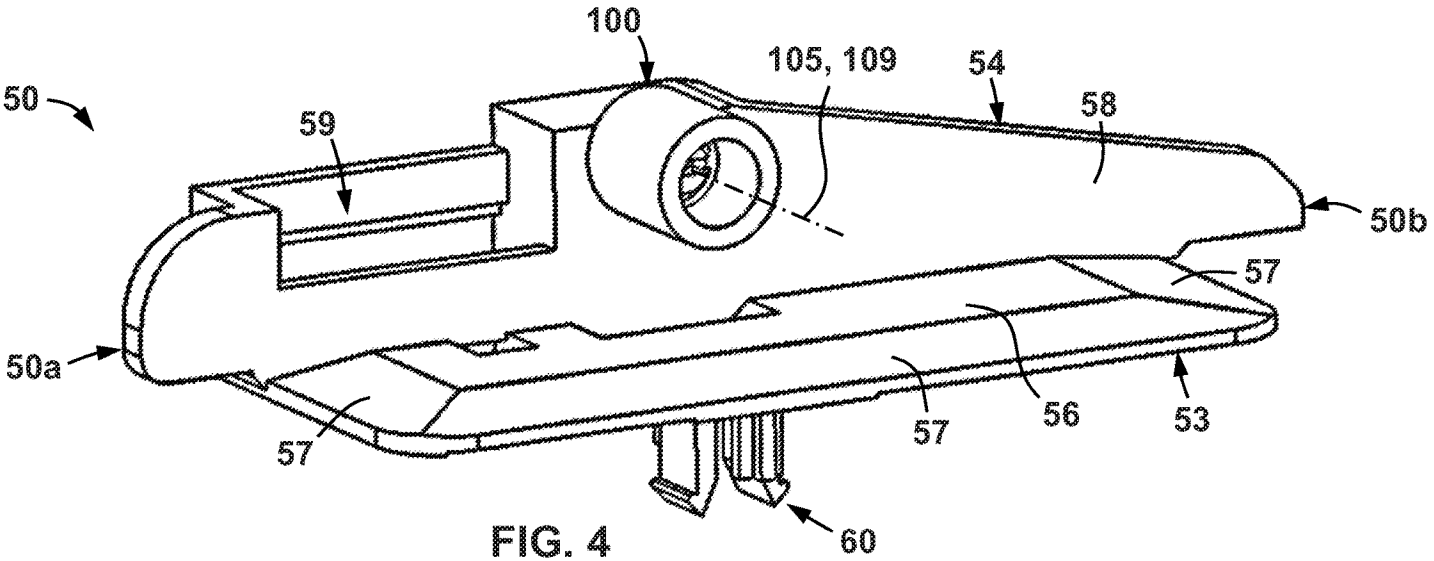
Figure 5:
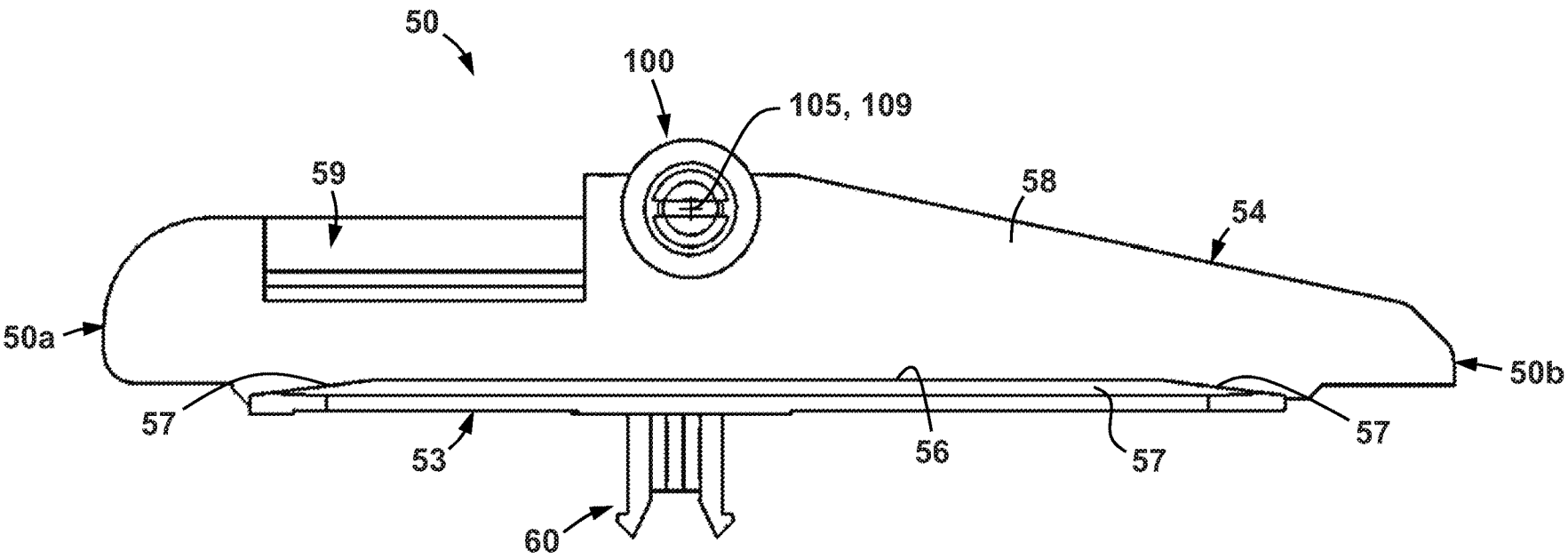
FIG. 5 is a side view of the first side guide of FIGS. 3 and 4.

Referring now to FIGS. 3-5, first side guide 50 includes a first end 50*a*, a second end 50*b* opposite first end 50*a*, a base 53, and a guide wall 54. Base 53 includes a planar base surface 56 and a plurality of ramped surfaces 57 extending from base surface 56. Referring briefly again to FIGS. 1 and 2, because side guides 50, 52 are disposed within recesses 30, 32, respectively, as previously described, base surface 56 may be co-planar with the support surface 26. However such alignment does not always occur, and in other examples, base surface 56 is either above or below support surface 26 of feed tray 20, but even in some of these examples, planar base surface 56 may be parallel to support surface 26.

Referring still to FIGS. 3-5, a connector 60 extends from base 53, opposite planar base surface 56. First side guide 50 is coupled to feed tray 20 by inserting connector 60 through the corresponding slot 34 disposed in recess 30 in support surface 26 (see FIG. 2).

Guide wall 54 defines a planar surface 58 extending between ends 50*a*, 50*b*. In this example, planar surface 58 is perpendicular to planar base surface 56 of base 53. In this example, a recess 59 extends into planar surface 58 on first side guide 50. Recess 59 receives latch 38 therethrough that is to selectively allow movement of first side guide 50 along support surface 26 as previously described.

Referring still to FIGS. 3-5, a fill indicator 100 is coupled to planar surface 58 of guide wall 54 (via a shaft 120 extending from planar surface 58 as will be described in more detail below—see FIG. 12) that is rotatable about an axis of rotation 105. As shown in FIG. 2, axis 105 extends perpendicularly to feed path 28 when first side guide 50 is installed on support surface 26. Further details of fill indicator 100 will be described in more detail below.

Figure 6:
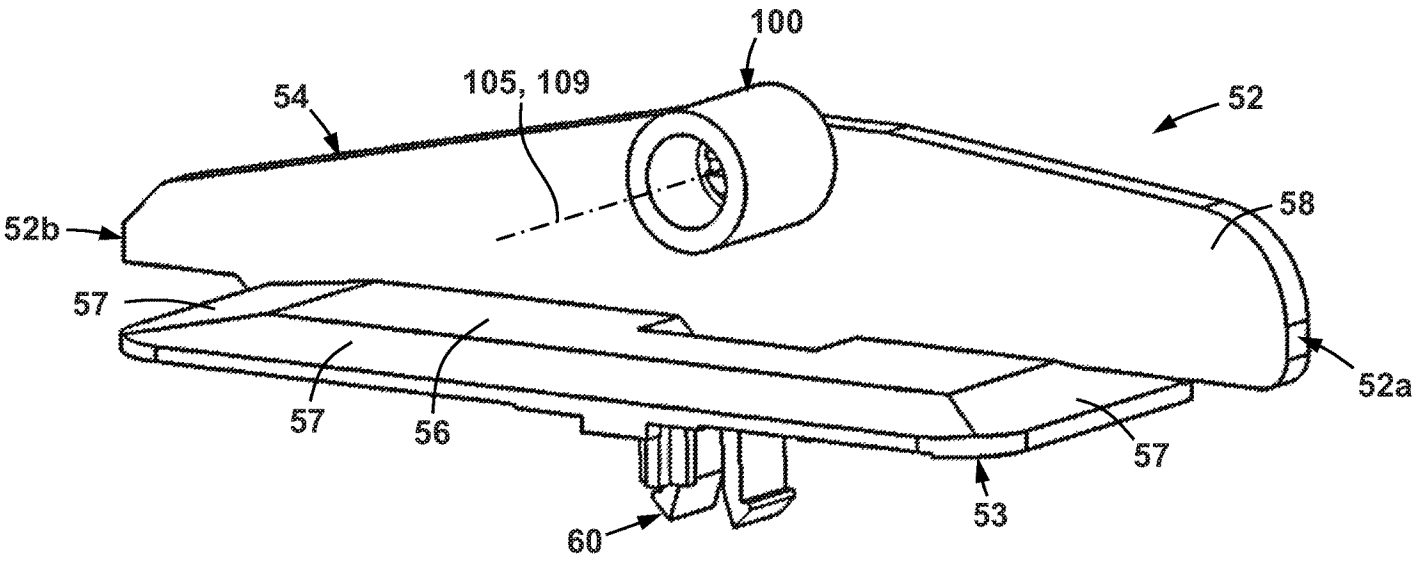
FIGS. 6 and 7 are perspective views of a second side guide for use within a feed tray of FIG. 2 according to some examples.
Figure 7:
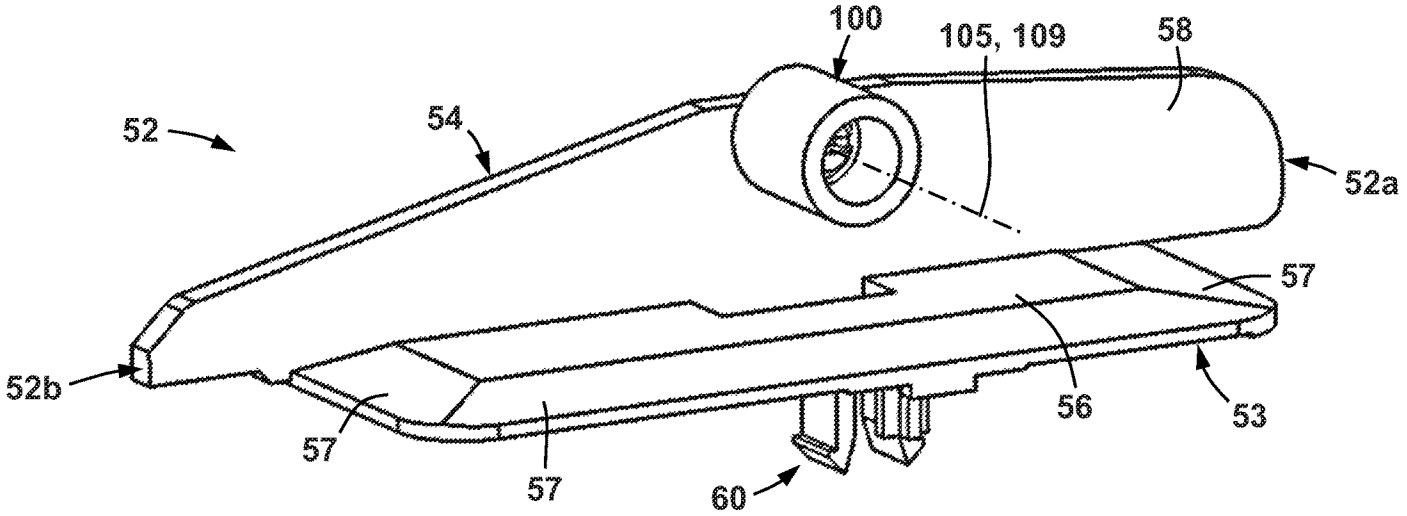
Figure 8:
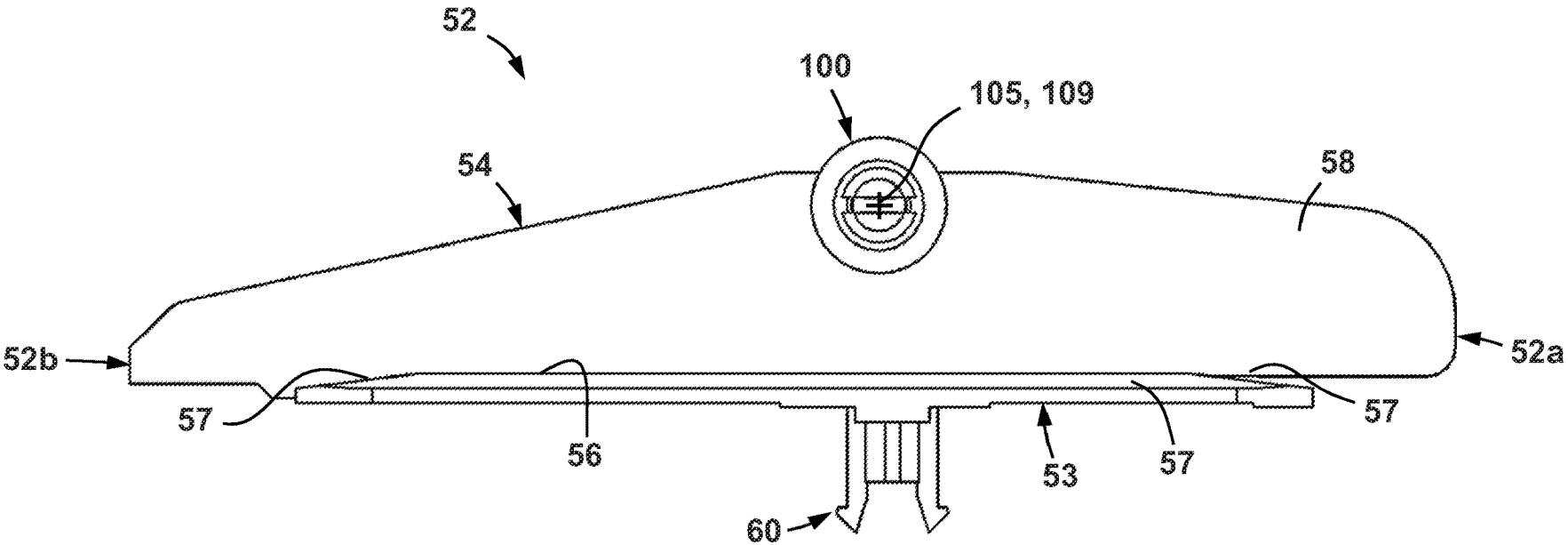
FIG. 8 is a side view of the second side guide of FIGS. 6 and 7.

Referring now to FIGS. 6-8, second side guide 52 is substantially the same as first side guide 50, and thus, like features are identified with like components and the description below will focus on the features of second side guide 52 that are different from first side guide 50. In particular, second side guide 52 includes a first end 52*a*, and a second end 52*b* opposite first end 52*a*. In addition, second side guide 52 includes base 53, connector 60, and guide wall 54, except that guide wall 54 does not include recess 59. As with planar surface 58 on first side guide 50, planar surface 58 on second side guide 52 extends perpendicularly to planar base surface 56 on base 53 between ends 52*a*, 52*b*. In addition, connector 60 on second side guide 52 is to engage within the corresponding slot 36 rather than slot 34 for first side guide 50.

Further, a fill indicator 100 (which is the same as fill indicator 100 on first side guide) is also coupled to planar surface 58 of guide wall 54 of second side guide 52 (again via a shaft 120 extending from planar surface 58 as will be described in more detail below—see FIG. 12) that is rotatable about a corresponding axis of rotation 105. As shown in FIG. 2, axis 105 of second side guide 52 extends perpendicularly to feed path 28 when second side guide 52 is installed on support surface 26. In addition, in this example, axes 105 of side guides 50, 52 (see FIG. 1) are generally aligned with one another. The details regarding the fill indicator 100 on the side guides 50, 52 will be described in more detail below.

Figure 10:
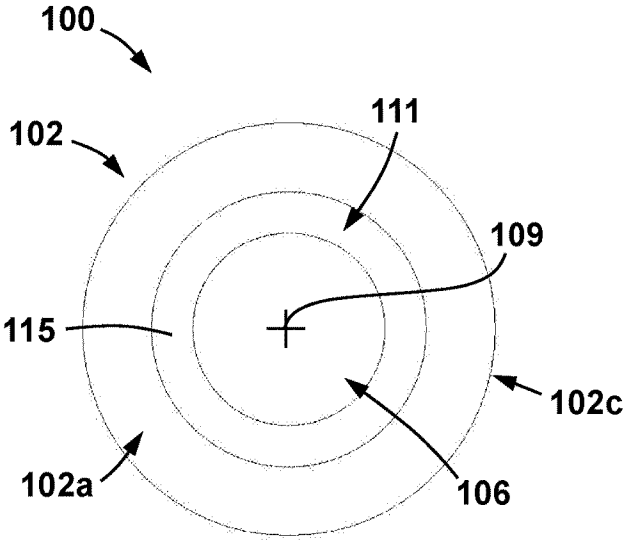
FIG. 10 is a front view of the roller of FIG. 9.
Figure 9:
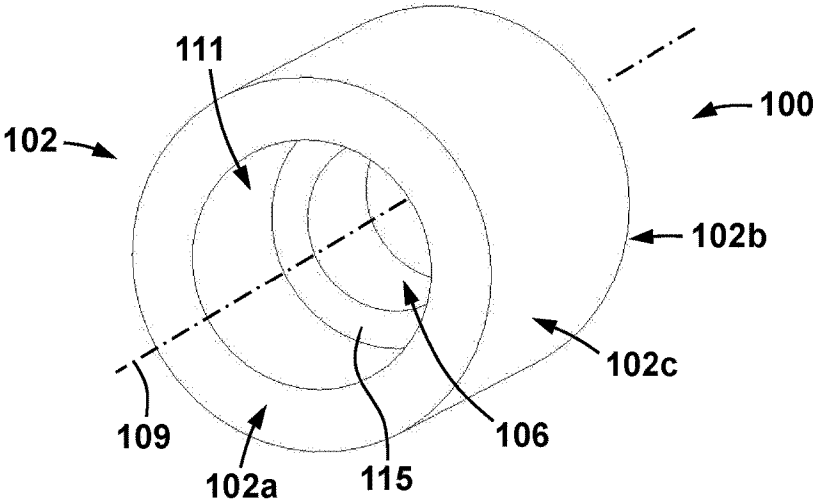
FIG. 9 is a perspective view of a roller for use on the side guides of FIGS. 3-8 according to some examples.
Figure 11:
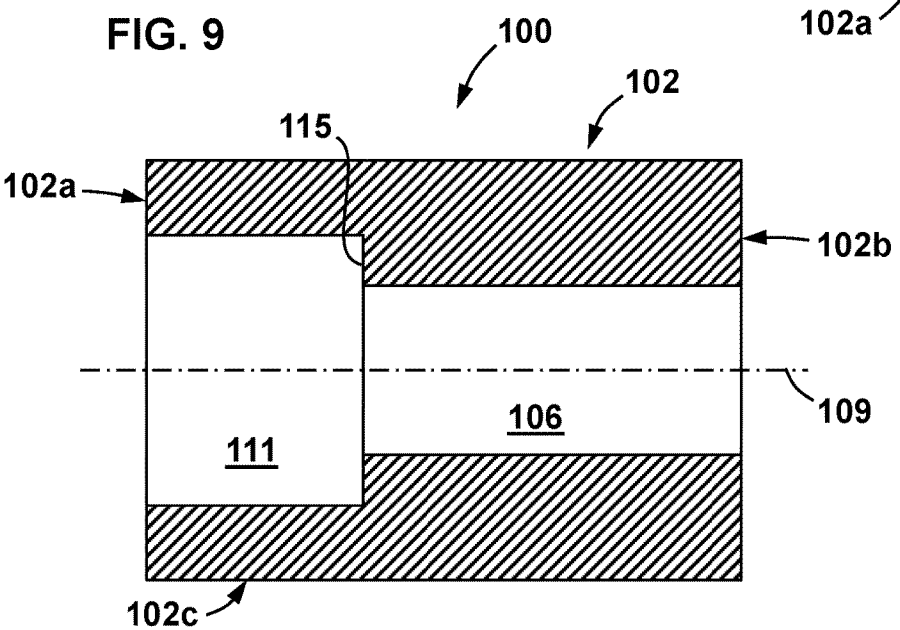
FIG. 11 is a side cross-sectional view of the roller of FIG. 9.

Referring now to FIGS. 9-11, an example fill indicator 100 for use on side guides 50, 52 is shown. In this example, the fill indicator 100 included on side guide 50 is the same as the fill indicator 100 disposed on second side guide 52. Thus, the same description (e.g., the following description with reference to FIGS. 9-11) is applicable to fully describe fill indicator 100 as it appears on both side guides 50, 52.

In this example, fill indicator 100 comprises a roller 102 including a longitudinal axis 109, a first or front side 102*a*, and a second or back side 102*b* opposite front side 102*a*. In addition, roller 102 includes a radially outer surface extending axially between sides 102*a*, 102*b* with respect to axis 109. In this example, radially outer surface 102*c* is a cylindrical surface; however, other shapes are possible in other examples.

In addition, roller 102 includes a cavity or recess 111 extending axially therein from front side 102*a*, and a throughbore 106 extending axially recess 111 to back side 102*b*. Due to the positioning of recess 111 and sides 102*a*, 102*b*, recess 111 may be referred to herein as a front recess 111. As best shown in FIGS. 10 and 11, an annular shoulder 115 is defined within front recess 111 that extends angularly about throughbore 106 with respect to axis 109.

Figure 12:
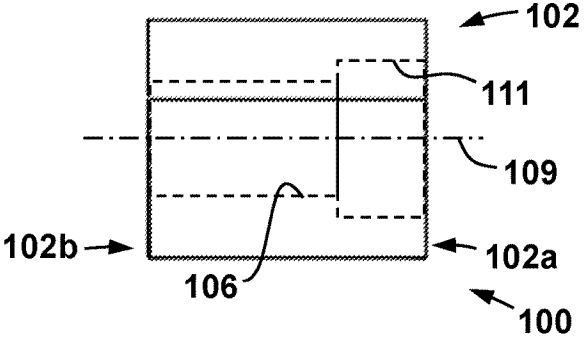
FIG. 12 is an exploded view of the cam of FIGS. 9-11 and the first side guide of FIGS. 3-5.
Figure 12:
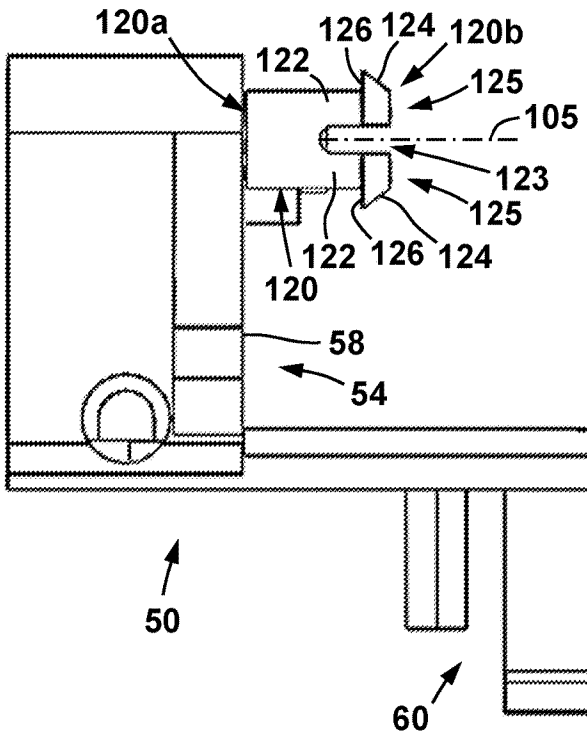
Figure 13:
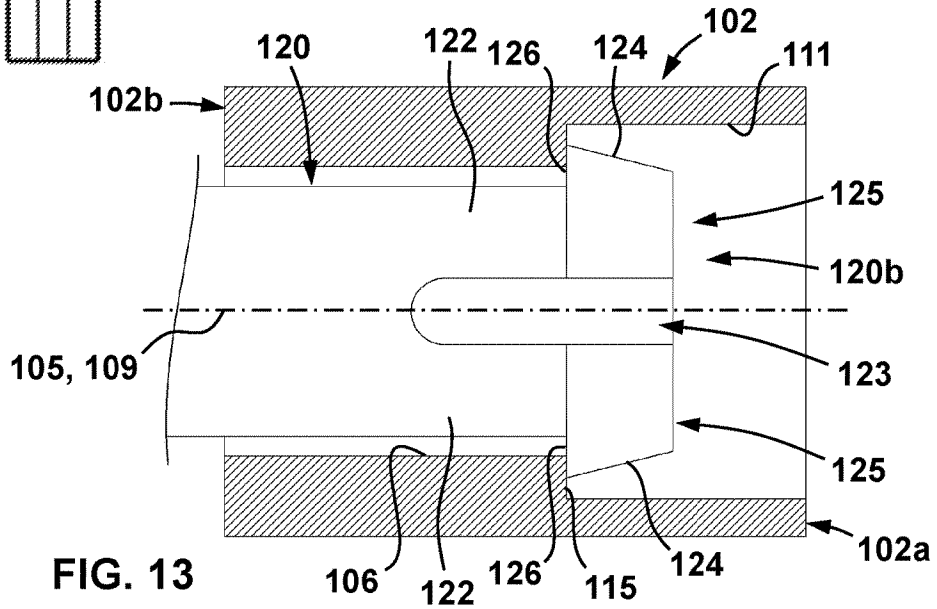
FIG. 13 is an enlarged cross-sectional view of the cam of FIGS. 9-11 installed on a shaft of the first side guide of FIGS. 3-5.

Referring now to FIGS. 12 and 13, the assembly of roller 102 on first side guide 50 is shown, it being understood that the installation of the roller 102 of the other fill indicator 100 coupled to second side guide 52 is accomplished in the same manner (and thus is not specifically shown in the interests of brevity). As shown in FIG. 12, roller 102 is mounted to planar surface 58 of guide wall 54 by inserting a shaft 120 extending from planar surface 58 into and through the aligned recess 111, and throughbore 106 such that axis 109 of roller 102 is aligned with axis 105.

Shaft 120 includes a first or proximal end 120*a*, and a second or distal end 120*b* opposite proximal end 120*a* along axis 105. Proximal end 120*a* is mounted to planar surface 58, and distal end 120*b* is axially spaced from planar surface 58 along axis 105. A slot or recess 123 extends axially into shaft 120 from distal end 120*b*, thereby defining a pair of collets or fingers 122 extending axially from distal end 120*b*. Each collet 122 includes an engagement member 125 at distal end 120*a* that defines a frustoconical surface 124 and an annular shoulder 126. In this example, frustoconical surface 124 is axially disposed between annular shoulder 126 and distal end 120*b* (i.e., annular shoulder 126 is axially disposed between frustoconical surface 124 and proximal end 120*a*).

During installation of roller 102, distal end 120*b* of shaft 120 is advanced axially through throughbore 106, and into front recess 111 along aligned axes 105, 109. Upon entering throughbore 106, frustoconcial surface 124 on the engagement member 125 on each collet 122 slidingly engages with the inner wall of throughbore 106 so that collets 122 are deflected radially inward toward axes 105, 109. As a result, distal end 120*b* of shaft 120 is able to advance axially within throughbore until each engagement member 125 emerges into front recess 111, at which time collets 122 spring or move radially outward so that annular shoulder 126 on each engagement member 125 radially overlaps with annular shoulder 115 in front recess 111. Accordingly, upon entering front recess 111, shaft 120 is prevented from being axially withdrawn back through throughbore 106 by the engagement of annular shoulders 126 and 115 of shaft 120 and roller 102, respectively.

Figure 14:
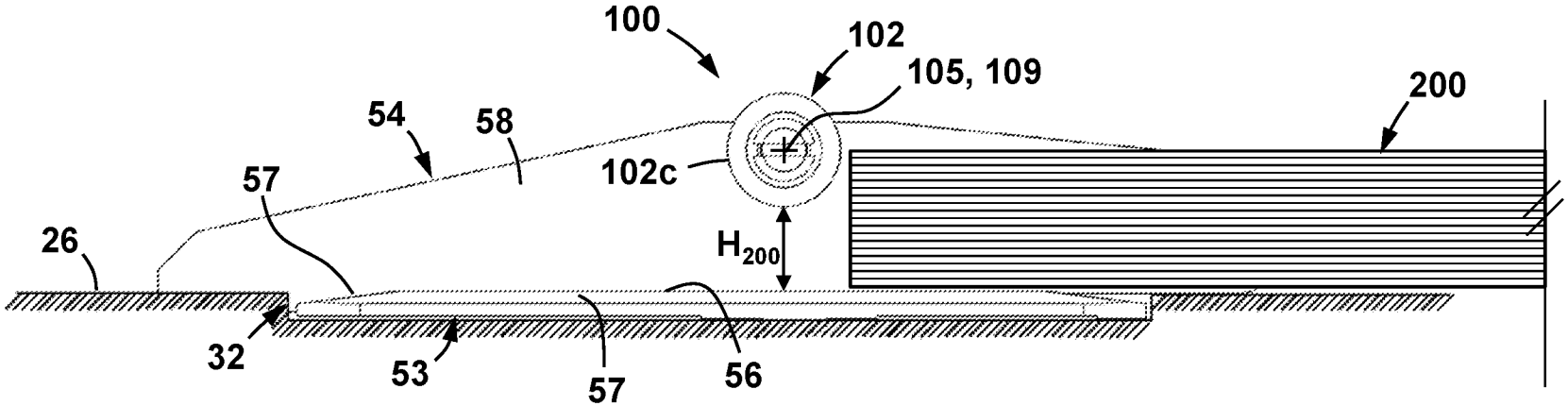
FIGS. 14 and 15 are sequential views of print media being loaded or installed within the feed tray of FIG. 2.
Figure 15:
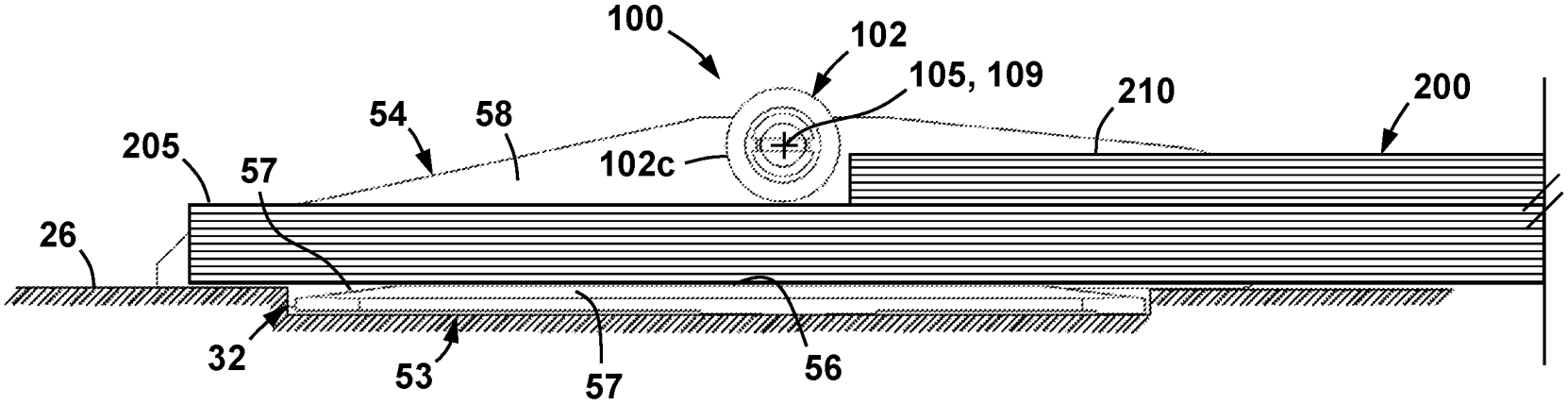

Referring now to FIGS. 1, 2, 14, and 15, an example sequence for loading print media 200 into feed tray 20 is shown. FIGS. 14 and 15 depicts second side guide 52 and the corresponding fill indicator 100 disposed thereon, but does not depict first side guide 50 and the corresponding fill indicator 100 disposed thereon in order to simplify FIGS. 14 and 15. However, it should be appreciated that the interaction between print media 200 and the fill indicator 100 installed on first side guide 50 is the same. Thus, while FIGS. 14 and 15 only show fill indicator 100 disposed on second side guide 52, it will be appreciated that the fill indicator 100 (and roller 102) disposed on first side guide 50 experiences the same deflection during the depicted sequence.

Generally speaking, when a user inserts or loads print media 200 into feed tray 20, the print media 200 may engage with the respective roller 102 on each side guide 50, 52, so that rollers 102 limit the amount of print media 200 that may be inserted therein.

More particularly, as shown in FIG. 14, during a loading sequence or operation for feed tray 20, a user inserts a stack of print media 200. Upon initially entering the feed tray 20, the print media 200 (or some portion thereof) engages with each roller 102 (that is the roller 102 on first side guide 50 and the roller 102 on second side guide 52—see FIG. 2). Specifically, the print media 200 engages with radially outer cylindrical surface 102*c* on each roller 102 so that each roller 102 separates the print media 200 into a first portion 205 and a second portion 210 (FIG. 15). First portion 205 of the print media 200 is of a sufficient size (or height) to fit between roller 102 and planar base surface 56 (and thus also support surface 26), while the second or remaining portion 210 is deflected or impeded by radially outer cylindrical surface 102*c* on roller 102. Therefore, the rollers 102 on side guides 50, 52 permit first portion 205 of print media 200 to advance along support surface 26 (and planar surface 56) into feed tray 20, while preventing entry of second portion 210. Thus, the distance or height $H_{200}$ of radially outermost cylindrical surface 102*c* of each respective roller 102 above planar surface 56 of base 53 (and thus also support surface 26) defines the maximum fill level (or the maximum stack height) for print media 200 within printer tray 20. Accordingly, fill indicators 100, particularly rollers 102 on side guides 50, 52, provide a physical barrier within feed tray 20 that prevents (or at least restricts) a user from inserting additional print media into tray above the predetermined maximum fill height $H_{200}$.

Referring still to FIGS. 1, 2, 14, and 15, during a subsequent printing operation, pieces (e.g., pages) of print media 200 are drawn into opening 14 in housing 12 of printer 10 from tray 20 as previously described (see FIGS. 1 and 2). During this process, if the print media 200 is in contact with radially outermost cylindrical surface 102*c*, roller 102 is to freely rotate about axes 105, 109 so that such contact does not impede or restrict the advance of print media 200 along feed path 28.

In addition, during a subsequent printing operation, the rollers 102 (particularly planar surface 114) may function as a de-skew tab within feed tray 20. Specifically, as pieces of print media 200 are pulled or drawn from first portion 205 into printer 10 (see FIG. 1), the print media 200 may (e.g., due to the engagement with the feed roller or other feeding components) lift or elevate within feed tray 20. However, the vertical lift of the print media 200 is curtailed or limited by the engagement of the piece of print media 200 and radially outermost cylindrical surface 102*c* of each roller 102. Accordingly, roller 102 may prevent additional skewing or deflection of the print media during such operations. As a result, it should be appreciated that in this example, feed tray 20 does not include additional de-skew tabs or extensions (that is, in addition to fill indicators 100).

Figure 16:
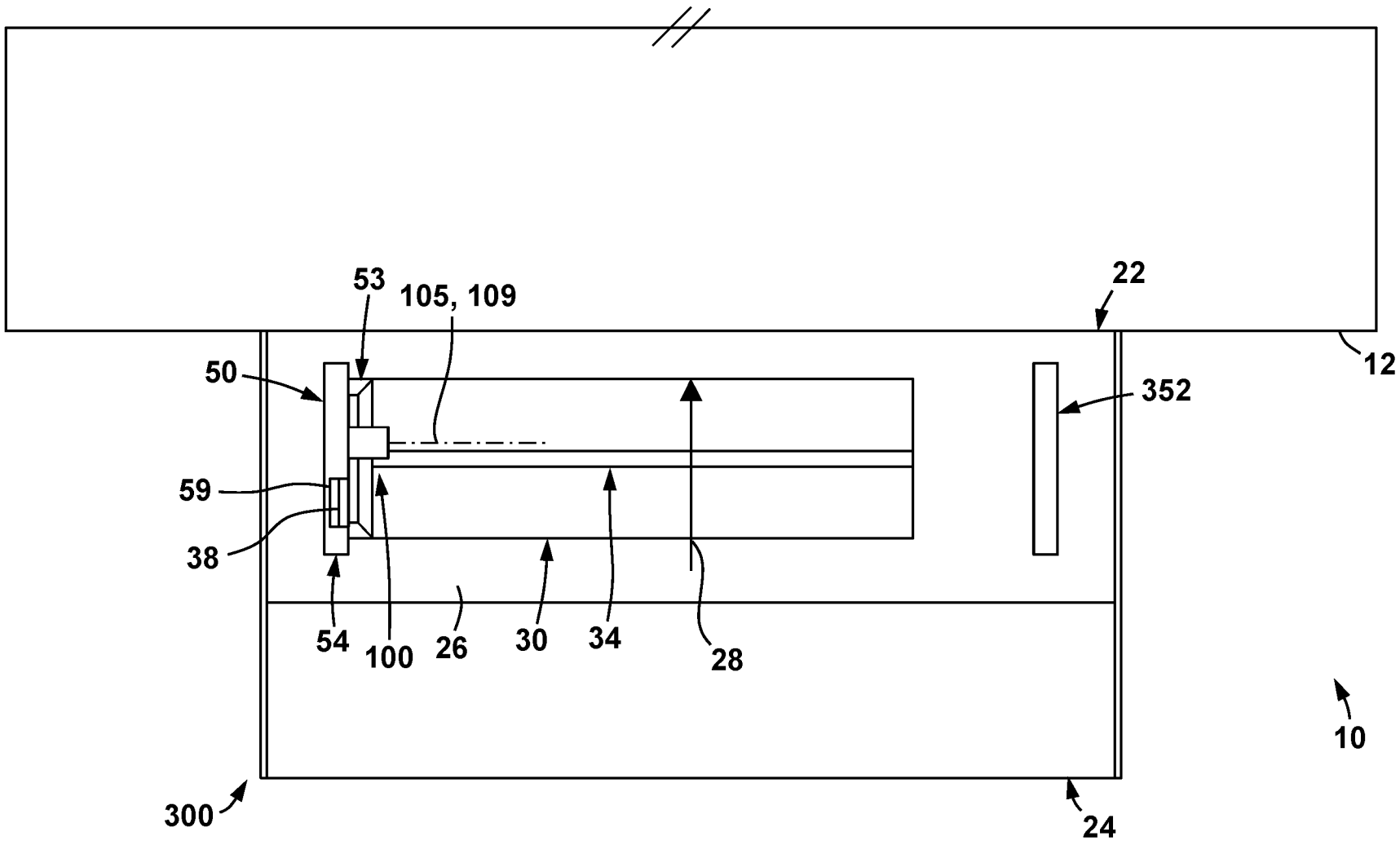
FIG. 16 is a schematic top view of another example of a printer tray according to some examples.

While examples disclosed herein have included printer trays having a pair of side guides that each include a fill indicator 100, it should be appreciated that other examples may include a single fill indicator 100 within printer tray 20. For example, referring now to FIG. 16, another example feed tray 300 for a printer (e.g., printer 10 in FIG. 1) is shown. Feed tray 300 is substantially the same as Feed tray 20 previously described, except that Feed tray 300 includes a second side guide 352 in place of second side guide 52. Second side guide 352 does not include a fill indicator 100. However, in this example, feed tray 300 includes first side guide 50, which does include a fill indicator 100 as previously described above. In addition, in this example, first side guide 50 is to move along support surface 26 as previously described above, while second side guide 352 is fixed relative to support surface 26. In still other examples, second side guide 352 may be omitted all together. Loading of print media 200 within feed tray 300 is substantially the same as for feed tray 20, previously described, except that the print media 200 (see FIGS. 14 and 15) engages with the single fill indicator on first side guide 50 rather than the pair of fill indicators 100 coupled to side guides 50, 52 as previously described above for tray 20 (see FIG. 2). Thus, a detailed discussion of this process is omitted in the interest of brevity.

Moreover, the examples disclosed herein have included fill indicators for use within an external feed tray 20 on a printer housing 12 (see FIGS. 1 and 2). However, it should be appreciated that in other examples, the fill indicators 100 and side guides (e.g., side guides 50, 52) may be utilized within an internal feed tray for a printer (e.g., such as a cassette tray disposed within housing 12 of printer 10). Therefore, the discussion above regarding external feed tray 20 should not be interpreted as limiting the use of the disclosed fill indicator 100 to this single type of feed tray for a printer.

The examples disclosed herein having included feed trays for printers that include fill indicators (e.g., fill indicator 100) for physically preventing or at least restricting the insertion of print media into the tray above a predetermined maximum fill level. Thus, through the use of the examples disclosed herein, the risk of jamming or skewing of the print media as a result of overfilling the feed tray is reduced (or eliminated). In addition, because the example fill indicator 100 disclosed herein is to freely rotate about a corresponding axis of rotation (e.g., axes 105, 109) when in contact with the print media (e.g., print media 200) that is being advanced into the printer during a printing operation, the advance of the print media is not impeded or restricted by the fill indicator during a subsequent printing operation.

The above discussion is meant to be illustrative of the principles and various examples of the present disclosure. Numerous variations and modifications will become apparent to those skilled in the art once the above disclosure is fully appreciated. It is intended that the following claims be interpreted to embrace all such variations and modifications.

What is claimed is:

1. A feed tray for a printer, the feed tray comprising:

a support surface to support print media;

a first guide wall coupled to the support surface, wherein the support surface and the first guide wall define a feed path for the print media into the printer, wherein the first guide wall is movable along the support surface; and a first fill indicator comprising a first roller mounted to the first guide wall that extends into the feed path, wherein the first roller is to rotate about a first axis of rotation that is perpendicular to the feed path, wherein the first roller is rotationally coupled to a first shaft extending from the first guide wall, wherein the first shaft comprises a plurality of axially extending collets.

2. The feed tray of claim 1, comprising:

a second guide wall coupled to the support surface; and a second fill indicator comprising a second roller mounted to the second guide wall that extends into the feed path, wherein the second roller of the second fill indicator is to rotate about a second axis of rotation that is perpendicular to the feed path.

3. The feed tray of claim 2, wherein the second axis of rotation is aligned with the first axis of rotation across the feed path.

4. The feed tray of claim 1, wherein each collet of the first shaft comprises an engagement member, wherein each engagement member comprises an annular shoulder.

5. The feed tray of claim 4, wherein the first roller comprises:

a first side;

a second side opposite the first side;

a first recess extending axially from the first side; and a throughbore extending from the first recess;

wherein the first recess defines a radially extending shoulder about the throughbore; and wherein the first shaft is received through the throughbore and into the first recess so that the annular shoulder on each engagement member is to engage with the radially extending shoulder in the first recess.

6. The feed tray of claim 5, wherein the first roller has a cylindrical radially outer surface.

7. A feed tray for a printer, the feed tray comprising:

a support surface to support print media; and a plurality of guide walls coupled to the support surface, wherein the support surface and the guide walls define a feed path for the print media into the printer, wherein each guide wall is movable along the support surface in a direction that is perpendicular to the feed path, wherein each guide wall includes a fill indicator comprising a roller mounted to a shaft extending from the corresponding guide wall along an axis of rotation that is perpendicular to the feed path, wherein each roller is to rotate about the corresponding axis of rotation, and wherein each shaft comprises a plurality of axially extending collets.

8. The feed tray of claim 7, wherein the plurality of axially extending collets of each shaft extend axially with respect to the corresponding axis of rotation.

9. The feed tray of claim 8, wherein the plurality of axially extending collets of each shaft comprise an engagement member, wherein each engagement member comprises an annular shoulder.

10. The feed tray of claim 9, wherein each roller comprises:

a first side;

a second side opposite the first side;

a first recess extending axially from the first side; and a throughbore extending from the first recess;

wherein the first recess defines a radially extending shoulder about the throughbore; and wherein the shaft is received through the throughbore and into the first recess so that the annular shoulder on each engagement member is to engage with the radially extending shoulder in the first recess.

11. The feed tray of claim 10, wherein the roller has a radially outer cylindrical surface.

12. A printer, comprising:

an outer housing; and a feed tray comprising:

a proximal end rotatably coupled to the outer housing;

a distal end spaced from the proximal end;

a support surface extending between the proximal end and the distal end;

a guide wall coupled to the support surface, wherein the support surface and the guide wall define a feed path for print media to be fed into the printer, wherein the guide wall is movable along the support surface; and a fill indicator comprising a roller mounted to the guide wall that extends into the feed path, wherein the roller is to rotate about an axis of rotation that is perpendicular to the feed path and is rotationally coupled to a shaft extending from the guide wall, and wherein the shaft comprises a plurality of axially extending collets.

13. The printer of claim 12, wherein each collet comprises an engagement member that defines an annular shoulder.

14. The printer of claim 13, wherein the roller comprises a throughbore and a radially extending shoulder axially adjacent the throughbore, and wherein the shaft is received through the throughbore so that the annular shoulder of the engagement member of each collet is to engage with the radially extending shoulder on the roller.

* * * * *